US006183057B1

(12) United States Patent
Sharma et al.

(10) Patent No.: US 6,183,057 B1
(45) Date of Patent: Feb. 6, 2001

(54) SELF-CLEANING INK JET PRINTER HAVING ULTRASONICS WITH REVERSE FLOW AND METHOD OF ASSEMBLING SAME

(75) Inventors: Ravi Sharma, Fairport; John A. Quenin, Rochester; Christopher N. Delametter, Rochester; Michael E. Meichle, Rochester, all of NY (US)

(73) Assignee: Eastman Kodak Company, Rochester, NY (US)

( * ) Notice: Under 35 U.S.C. 154(b), the term of this patent shall be extended for 0 days.

(21) Appl. No.: 09/206,272

(22) Filed: Dec. 4, 1998

(51) Int. Cl.[7] ..... B41J 2/165
(52) U.S. Cl. ..... 347/27
(58) Field of Search ..... 347/27, 29, 32, 347/89, 93

(56) References Cited

U.S. PATENT DOCUMENTS

| | | | | |
|---|---|---|---|---|
| 3,373,437 | | 3/1968 | Sweet et al. | 347/74 |
| 3,416,153 | | 12/1968 | Hertz et al. | 347/73 |
| 3,705,043 | | 12/1972 | Zabiak | 106/31.46 |
| 3,776,642 | | 12/1973 | Anson et al. | 356/418 |
| 3,846,141 | | 11/1974 | Ostergren et al. | 106/31.43 |
| 3,870,528 | | 3/1975 | Edds et al. | 106/31.47 |
| 3,878,519 | | 4/1975 | Eaton | 347/75 |
| 3,889,269 | | 6/1975 | Meyer et al. | 347/100 |
| 3,903,034 | | 9/1975 | Zabiak et al. | 524/247 |
| 4,346,387 | | 8/1982 | Hertz | 347/75 |
| 4,380,770 | * | 4/1983 | Maruyama | 347/29 |
| 4,591,870 | | 5/1986 | Braun et al. | 347/25 |
| 4,600,928 | | 7/1986 | Braun et al. | 347/27 |
| 4,849,769 | | 7/1989 | Dressler | 347/27 |
| 4,970,535 | | 11/1990 | Oswald et al. | 347/25 |
| 5,115,250 | | 5/1992 | Harmon et al. | 347/33 |
| 5,148,746 | | 9/1992 | Fuller et al. | 101/142 |
| 5,305,015 | | 4/1994 | Schantz et al. | 347/47 |
| 5,350,616 | | 9/1994 | Pan et al. | 428/131 |
| 5,426,458 | | 6/1995 | Wenzel et al. | 347/45 |
| 5,431,722 | | 7/1995 | Yamashita et al. | 106/31.43 |
| 5,534,896 | * | 7/1996 | Osborne | 347/29 |
| 5,559,536 | | 9/1996 | Minoru et al. | 347/25 |
| 5,574,485 | | 11/1996 | Anderson et al. | 347/27 |
| 5,725,647 | | 3/1998 | Carlson et al. | 106/31.86 |
| 5,738,716 | | 4/1998 | Santilli et al. | 106/31.77 |
| 5,774,140 | | 6/1998 | English | 347/33 |

FOREIGN PATENT DOCUMENTS

| | | |
|---|---|---|
| 361393 | 4/1990 | (EP) . |
| 96 35584 | 11/1996 | (WO) . |

* cited by examiner

*Primary Examiner*—N. Le
*Assistant Examiner*—Michael Nghiem
(74) *Attorney, Agent, or Firm*—Walter S. Stevens

(57) ABSTRACT

Self-cleaning printer with reverse fluid flow and ultrasonics and method of assembling the printer. The printer comprises a print head defining a plurality of ink channels therein, each ink channel terminating in an ink ejection orifice. The print head also has a surface thereon surrounding all the orifices. Contaminant may reside on the surface and also may completely or partially obstruct the orifice. Therefore, a cleaning assembly is disposed relative to the surface and/or orifice for directing a flow of fluid along the surface and/or across the orifice to clean the contaminant from the surface and/or orifice. The cleaning assembly includes a septum disposed opposite the surface or orifice for defining a gap therebetween. Presence of the septum accelerates the flow of fluid through the gap to induce a hydrodynamic shearing force in the fluid. This shearing force acts against the contaminant to clean the contaminant from the surface and/or orifice. A pump in fluid communication with the gap is also provided for pumping the fluid through the gap. As the surface and/or orifice is cleaned, the contaminant is entrained in the fluid. A filter is provided to separate the contaminant from the fluid. In addition, a valve system in fluid communication with the gap is operable to direct flow of the fluid through the gap in a first direction and then in a second direction opposite the first direction to enhance cleaning effectiveness. Moreover, an ultrasonic transducer induces pressure waves in the fluid to dislodge the contaminant and thus clean the surface and/or orifice.

30 Claims, 14 Drawing Sheets

SELF-CLEANING INK JET PRINTER HAVING ULTRASONICS WITH REVERSE FLOW AND METHOD OF ASSEMBLING SAME

BACKGROUND OF THE INVENTION

This invention generally relates to ink jet printer apparatus and methods and more particularly relates to a self-cleaning ink jet printer with reverse fluid flow and ultrasonics and method of assembling the printer.

An ink jet printer produces images on a receiver by ejecting ink droplets onto the receiver in an imagewise fashion. The advantages of non-impact, low-noise, low energy use, and low cost operation in addition to the capability of the printer to print on plain paper are largely responsible for the wide acceptance of ink jet printers in the marketplace.

In this regard, "continuous" ink jet printers utilize electrostatic charging tunnels that are placed close to the point where ink droplets are being ejected in the form of a stream. Selected ones of the droplets are electrically charged by the charging tunnels. The charged droplets are deflected downstream by the presence of deflector plates that have a predetermined electric potential difference between them. A gutter may be used to intercept the charged droplets, while the uncharged droplets are free to strike the recording medium.

In the case of "on demand" ink jet printers, at every orifice a pressurization actuator is used to produce the ink jet droplet. In this regard, either one of two types of actuators may be used. These two types of actuators are heat actuators and piezoelectric actuators. With respect to heat actuators, a heater placed at a convenient location heats the ink and a quantity of the ink will phase change into a gaseous steam bubble and raise the internal ink pressure sufficiently for an ink droplet to be expelled to the recording medium. With respect to piezoelectric actuators. A piezoelectric material is used, which piezoelectric material possess piezoelectric properties such that an electric field is produced when a mechanical stress is applied. The converse also holds true; that is, an applied electric field will produce a mechanical stress in the material. Some naturally occurring materials possessing these characteristics are quartz and tourmaline. The most commonly produced piezoelectric ceramics are lead zirconate titanate, barium titanate, lead titanate, and lead metaniobate.

Inks for high speed ink jet printers, whether of the "continuous" or "piezoelectric" type, must have a number of special characteristics. For example, the ink should incorporate a nondrying characteristic, so that drying of ink in the ink ejection chamber is hindered or slowed to such a state that by occasional spitting of ink droplets, the cavities and corresponding orifices are kept open. The addition of glycol facilitates free flow of ink through the ink jet chamber. Of course, the ink jet print head is exposed to the environment where the ink jet printing occurs. Thus, the previously mentioned orifices are exposed to many kinds of air born particulates. Particulate debris may accumulate on surfaces formed around the orifices and may accumulate in the orifices and chambers themselves. That is, the ink may combine with such particulate debris to form an interference burr that blocks the orifice or that alters surface wetting to inhibit proper formation of the ink droplet. The particulate debris should be cleaned from the surface and orifice to restore proper droplet formation. In the prior art, this cleaning is commonly accomplished by brushing, wiping, spraying, vacuum suction, and/or spitting of ink through the orifice.

Thus, inks used in ink jet printers can be said to have the following problems: the inks tend to dry-out in and around the orifices resulting in clogging of the orifices; and the wiping of the orifice plate causes wear on plate and wiper, the wiper itself producing particles that clog the orifice.

Ink jet print head cleaners are known. An ink jet print head cleaner is disclosed in U.S. Pat. No. 4,600,928 titled "Ink Jet Printing Apparatus Having Ultrasonic Print Head Cleaning System" issued Jul. 15, 1986 in the name of Hilarion Braun and assigned to the asignee of the present invention. This patent discloses a continuous ink jet printing apparatus having a cleaning system whereby ink is supported proximate droplet orifices, a charge plate and/or a catcher surface and ultrasonic cleaning vibrations are imposed on the supported ink mass. The ink mass support is provided by capillary forces between the charge plate and an opposing wall member and the ultrasonic vibrations are provided by a stimulating transducer on the print head body and transmitted to the charge plate surface by the supported liquid. However, the Braun cleaning technique does not appear to directly clean ink droplet orifices and ink channels.

Therefore, there is a need to provide a self-cleaning printer with reverse fluid flow and ultrasonics and method of assembling the printer.

SUMMARY OF THE INVENTION

An object of the present invention is to provide a self-cleaning printer with reverse fluid flow and ultrasonics and method of assembling the printer, which reverse fluid flow and ultrasonics enhance cleaning effectiveness.

With this object in view, the present invention resides in a self-cleaning printer, comprising: a print head having a surface thereon; a structural member disposed opposite the surface for defining a gap therebetween sized to allow a flow of fluid in a first direction through the gap, said member accelerating the fluid to induce a shearing force in the fluid, whereby the shearing force acts against the surface while the shearing force is induced in the fluid; a junction coupled to the gap for changing flow of the fluid from the first direction to a second direction opposite the first direction, whereby the fluid is agitated while the fluid changes from the first direction to the second direction; and a pressure pulse generator in fluid communication with the fluid for generating a pressure wave propagating in the fluid and acting against the surface, whereby the surface is cleaned while the shearing force and the pressure wave act against the surface and while the fluid is agitated.

According to an exemplary embodiment of the present invention, the self-cleaning printer comprises a print head defining a plurality of ink channels therein, each ink channel terminating in an orifice. The print head also has a surface thereon surrounding all the orifices. The print head is capable of ejecting ink droplets through the orifice, which ink droplets are intercepted by a receiver (e.g., paper or transparency) supported by a platen roller disposed adjacent the print head. Contaminant such as an oily film-like deposit or particulate matter may reside on the surface and may completely or partially obstruct the orifice. The oily film may, for example, be grease and the particulate matter may be particles of dirt, dust, metal and/or encrustations of dried ink. Presence of the contaminant interferes with proper ejection of the ink droplets from their respective orifices and therefore may give rise to undesirable image artifacts, such as banding. It is therefore desirable to clean the contaminant from the surface.

Therefore, a cleaning assembly is disposed relative to the surface and/or orifice for directing a flow of fluid along the surface and/or across the orifice to clean the contaminant from the surface and/or orifice. As described in detail herein, the cleaning assembly is configured to direct fluid flow in a forward direction across the surface and/or orifice and then in a reverse direction across the surface and/or orifice. This to-and-fro motion enhances cleaning efficiency. In addition, the cleaning assembly includes a septum disposed opposite the surface and/or orifice for defining a gap therebetween. The gap is sized to allow the flow of fluid through the gap. Presence of the septum accelerates the flow of fluid in the gap to induce a hydrodynamic shearing force in the fluid. This shearing force acts against the contaminant and cleans the contaminant from the surface and/or orifice. Combination of the aforementioned to-and-fro motion and acceleration of fluid flow through the gap (due to the septum) provides efficient and satisfactory cleaning of the surface and/or orifice. Moreover, an ultrasonic transducer is provided to generate pressure waves in the fluid to enhance cleaning. A pump in fluid communication with the gap is also provided for pumping the fluid through the gap. In addition, a filter is provided to filter the particulate mater from the fluid for later disposal.

A feature of the present invention is the provision of a septum disposed opposite the surface and/or orifice for defining a gap therebetween capable of inducing a hydrodynamic shearing force in the gap, which shearing force removes the contaminant from the surface and/or orifice.

Another feature of the present invention is the provision of a piping circuit including a valve system for directing fluid flow through the gap in a first direction and then redirecting fluid flow through the gap in a second direction opposite the first direction.

Yet another feature of the present invention is the provision of an ultrasonic tranducer in fluid communication with the gap for inducing pressure waves in the gap.

An advantage of the present invention is that the cleaning assembly belonging to the invention directly and effectively cleans the print head surface, ink droplet orifices and ink channels.

These and other objects, features and advantages of the present invention will become apparent to those skilled in the art upon a reading of the following detailed description when taken in conjunction with the drawings wherein there are shown and described illustrative embodiments of the invention.

BRIEF DESCRIPTION OF THE DRAWINGS

While the specification concludes with claims particularly pointing out and distinctly claiming the subject matter of the present invention, it is believed the invention will be better understood from the following detailed description when taken in conjunction with the accompanying drawings wherein:

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Figure 1:
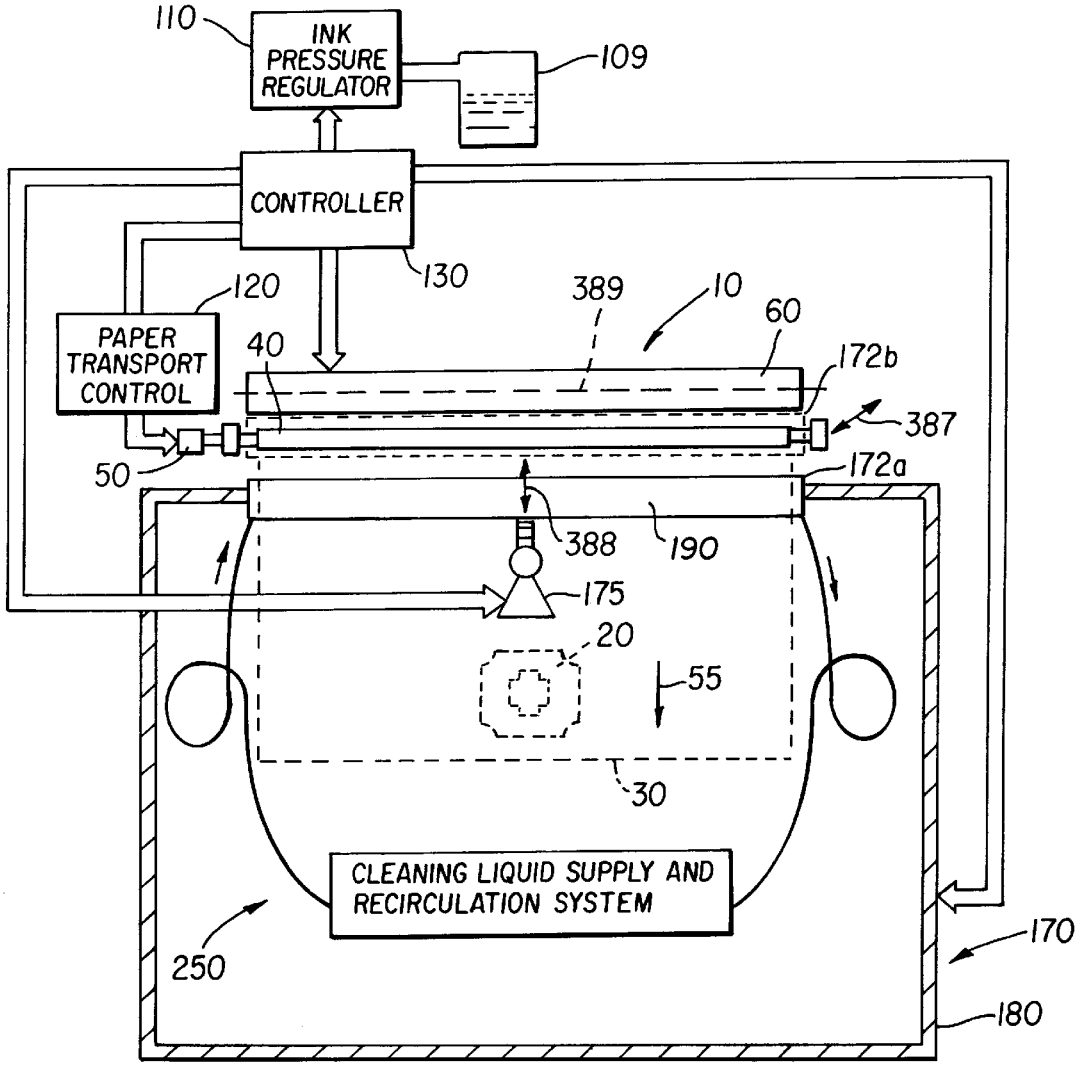
FIG. 1 is a view in elevation of a self-cleaning ink jet printer belonging to the present invention, the printer including a page-width print head.

Therefore, referring to FIG. 1, there is shown a self-cleaning printer, generally referred to as 10, for printing an image 20 on a receiver 30, which may be a reflective-type receiver (e.g., paper) or a transmissive-type receiver (e.g., transparency). Receiver 30 is supported on a platen roller 40 which is capable of being rotated by a platen roller motor 50 engaging platen roller 40. Thus, when platen roller motor 50 rotates platen roller 40, receiver 30 will advance in a direction illustrated by a first arrow 55.

Figure 2:
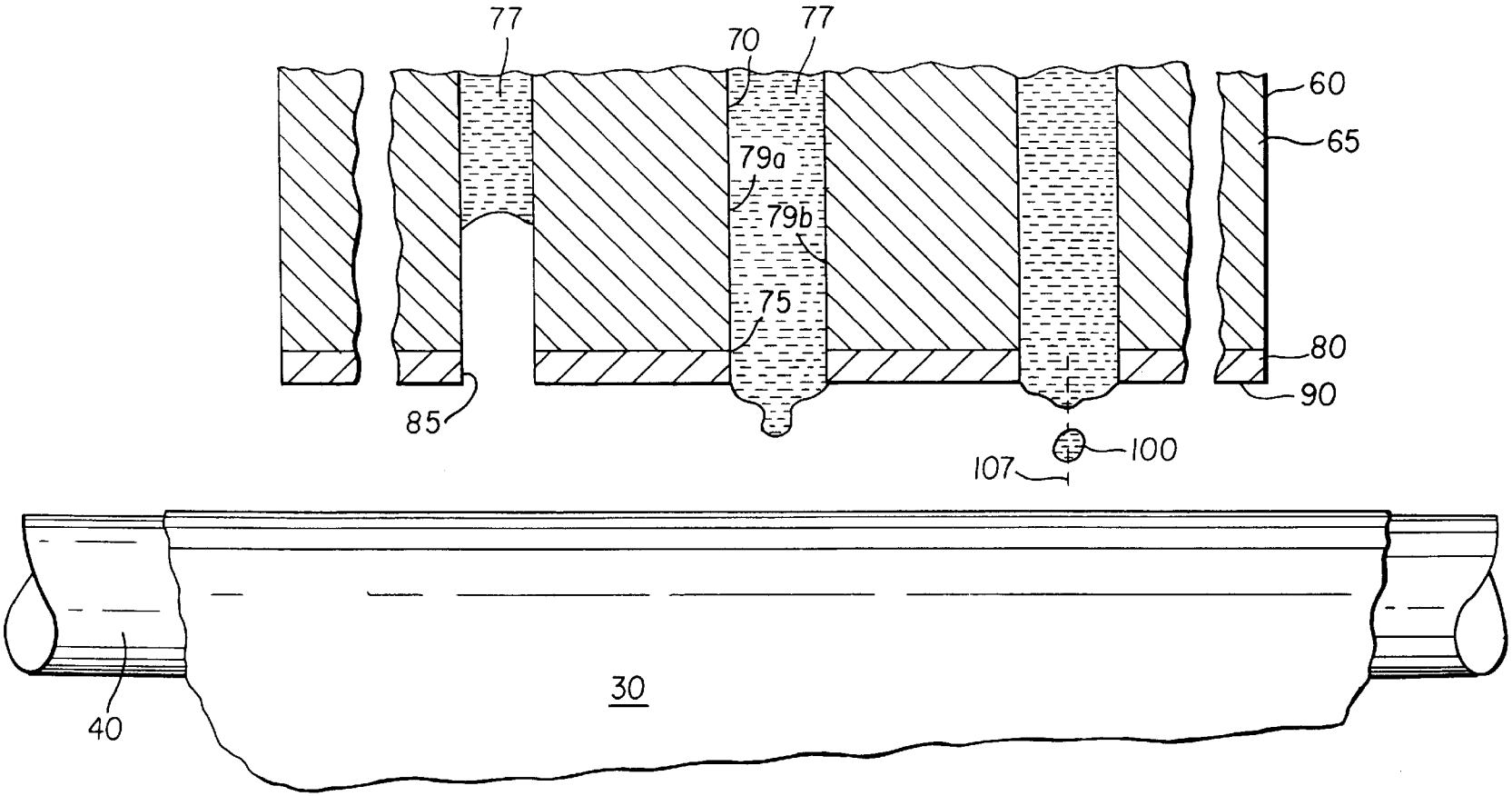
FIG. 2 is a fragmentation view in vertical section of the print head, the print head defining a plurality of channels therein, each channel terminating in an orifice.

Referring to FIGS. 1 and 2, printer 10 also comprises a "page-width" print head 60 disposed adjacent to platen roller 40. Print head 60 comprises a print head body 65 having a plurality of ink channels 70, each channel 70 terminating in a channel outlet 75. In addition, each channel 70, which is adapted to hold an ink body 77 therein, is defined by a pair of oppositely disposed parallel side walls 79*a* and 79*b*. Attached, such as by a suitable adhesive, to print head body 65 is a cover plate 80 having a plurality of orifices 85 formed therethrough colinearly aligned with respective ones of channel outlets 75. A surface 90 of cover plate 80 surrounds all orifices 85 and faces receiver 20. Of course, in order to print image 20 on receiver 30, an ink droplet 100 must be released from orifice 85 in direction of receiver 20, so that droplet 100 is intercepted by receiver 20. To achieve this result, print head body 65 may be a "piezoelectric ink jet" print head body formed of a piezoelectric material, such as lead zirconium titanate (PZT). Such a piezoelectric material is mechanically responsive to electrical stimuli so that side walls 79*a/b* simultaneously inwardly deform when electrically stimulated. When side walls 79*a/b* simultaneously inwardly deform, volume of channel 70 decreases to squeeze ink droplet 100 from channel 70. Ink droplet 100 is preferably ejected along a first axis 107 normal to orifice 85. Of course, ink is supplied to channels 70 from an ink supply container 109. Also, supply container 109 is preferably pressurized such that ink pressure delivered to print head 60 is controlled by an ink pressure regulator 110.

Still referring to FIGS. 1 and 2, receiver 30 is moved relative to page-width print head 60 by rotation of platen roller 40, which is electronically controlled by paper transport control system 120. Paper transport control system 120 is in turn controlled by controller 130. Paper transport control system 120 disclosed herein is by way of example only, and many different configurations are possible based on the teachings herein. In the case of page-width print head 60, it is more convenient to move receiver 30 past stationary head 60. Controller 130, which is connected to platen roller motor 50, ink pressure regulator 110 and a cleaning assembly, enables the printing and print head cleaning operations. Structure and operation of the cleaning assembly is described in detail hereinbelow. Controller 130 may be a model CompuMotor controller available from Parker Hannifin in Rohrnert Park, Calif.

Figure 3:
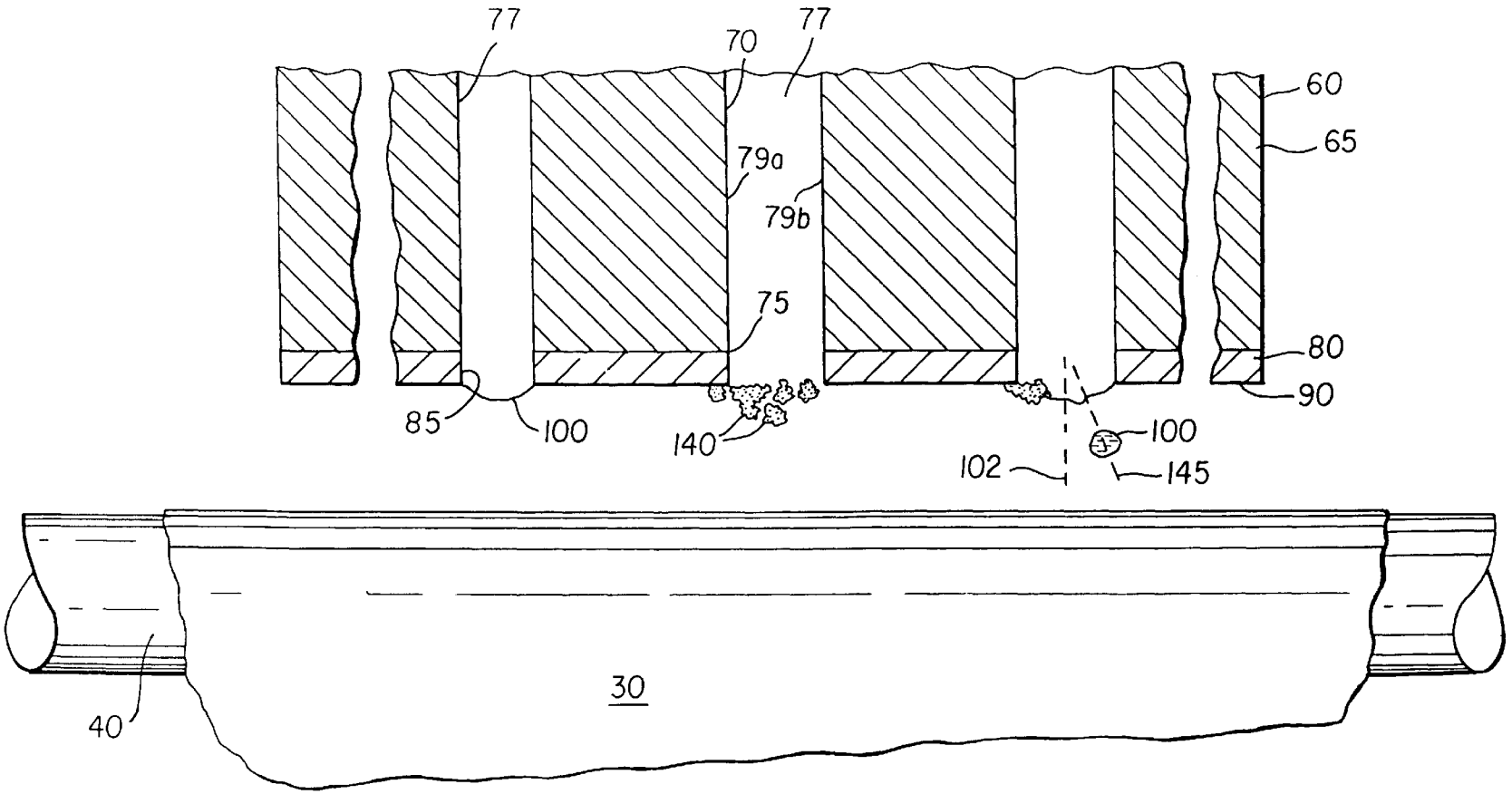
FIG. 3 is a fragmentation view in vertical section of the print head, this view showing some of the orifices encrusted with contaminant to be removed.
Figure 4:
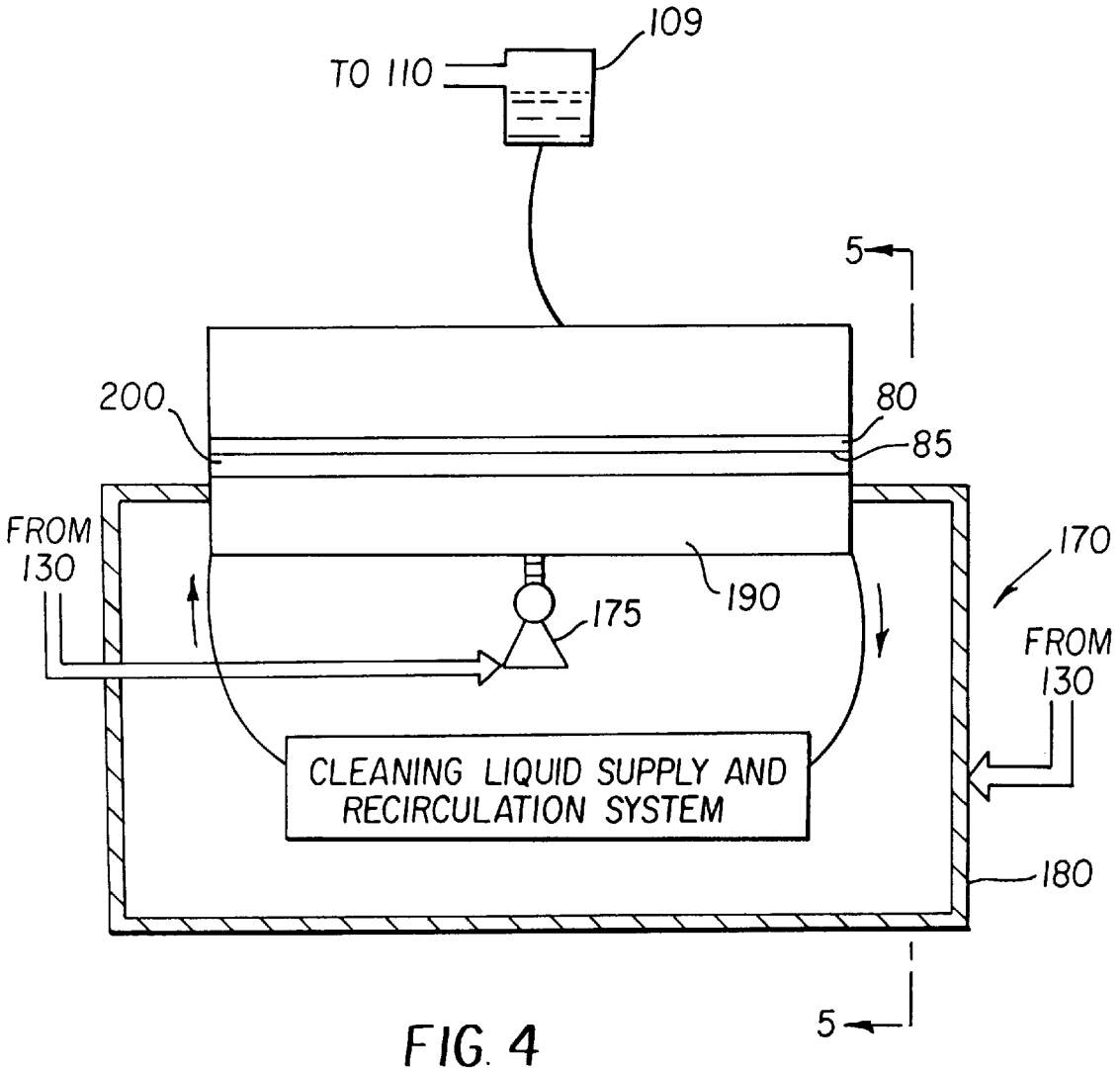
FIG. 4 is a view in elevation of a cleaning assembly for removing the contaminant.

Turning now to FIG. 3, it has been observed that cover plate 80 may become fouled by contaminant 140. Contaminant 140 may be, for example, an oily film or particulate matter residing on surface 90. Contaminant 140 also may partially or completely obstruct orifice 85. The particulate matter may be, for example, particles of dirt, dust, metal and/or encrustations of dried ink. The oily film may be, for example, grease or the like. Presence of contaminant 140 is undesirable because when contaminant 140 completely obstructs orifice 85, ink droplet 100 is prevented from being ejected from orifice 85. Also, when contaminant 140 partially obstructs orifice 85, flight of ink droplet 100 may be diverted from first axis 107 to travel along a second axis 145 (as shown). If ink droplet 100 travels along second axis 145, ink droplet 100 will land on receiver 30 in an unintended location. In this manner, such complete or partial obstruction of orifice 85 leads to printing artifacts such as "banding", a highly undesirable result. Also, presence of contaminant 140 may alter surface wetting and inhibit proper formation of droplet 100. Therefore, it is desirable to clean (i.e., remove) contaminant 140 to avoid printing artifacts.

Therefore, referring to FIGS. 1, 4, 5, 6 and 7, a cleaning assembly, generally referred to as 170, is disposed proximate surface 90 for directing a flow of cleaning liquid along surface 90 and across orifice 85 to clean contaminant 140 therefrom. Cleaning assembly 170 is movable from a first or "rest" position 172*a* spaced-apart from surface 90 to a second position 172*a* engaging surface 90. This movement is accomplished by means of an elevator 175 coupled to controller 130. Cleaning assembly 170 may comprise a housing 180 for reasons described presently. Disposed in housing 180 is a generally rectangular cup 190 having an open end 195. Cup 190 defines a cavity 197 communicating with open end 195. Attached, such as by a suitable adhesive, to open end 195 is an elastomeric seal 200, which may be rubber or the like, sized to encircle one or more orifices 85 and sealingly engage surface 90. Extending along cavity 197 and oriented perpendicularly opposite orifices 85 is a structural member, such as an elongate septum 210. Septum 210 has an end portion 215 which, when disposed opposite orifice 85, defines a gap 220 of predetermined size between orifice 85 and end portion 215. Moreover, end portion 215 of septum 210 may be disposed opposite a portion of surface 90, not including orifice 85, so that gap 220 is defined between surface 90 and end portion 215. As described in more detail hereinbelow, gap 220 is sized to allow flow of a liquid therethrough in order to clean contaminant 140 from surface 90 and/or orifice 85. By way of example only, and not by way of limitation, the velocity of the liquid flowing through gap 220 may be about 1 to 20 meters per second. Also by way of example only, and not by way of limitation, height of gap 220 may be approximately 3 to 30 thousandths of an inch. Moreover, hydrodynamic pressure applied to contaminant 140 in gap 220 due, at least in part, to presence of septum 210 may be approximately 1 to 30 psi (pounds per square inch). Septum 210 partitions (i.e., divides) cavity 197 into an first chamber 230 and a second chamber 240, for reasons described more fully hereinbelow. An ultrasonic transducer 245 capable of generating a plurality of pressure pulse waves 247 is also provided for enhancing cleaning effectiveness, as described in detail hereinbelow.

Referring again to FIGS. 1, 4, 5 and 6, interconnecting first chamber 230 and second chamber 240 is a closed-loop piping circuit 250. It will be appreciated that piping circuit 250 is in fluid communication with gap 220 for recycling the liquid through gap 220. In this regard, piping circuit 250 comprises a first piping segment 260 extending from second chamber 240 to a reservoir 270 containing a supply of the liquid. Piping circuit 250 further comprises a second piping segment 280 extending from reservoir 270 to first chamber 230. Disposed in second piping segment 280 is a recirculation pump 290. During a "forward flow" mode of operation, pump 290 pumps the liquid from reservoir 270, through second piping segment 280, into first chamber 230, through gap 220, into second chamber 240, through first piping segment 260 and back to reservoir 270, as illustrated by a plurality of second arrows 295. Disposed in first piping segment 260 may be a first filter 300 and disposed in second piping segment 280 may be a second filter 310 for filtering (i.e., separating) contaminant 140 from the liquid as the liquid circulates through piping circuit 250. It will be appreciated that portions of the piping circuit 250 adjacent to cup 190 are preferably made of flexible tubing in order to facilitate uninhibited translation of cup 190 toward and away from print head 60, which translation is accomplished by means of elevator 175.

Figure 5:
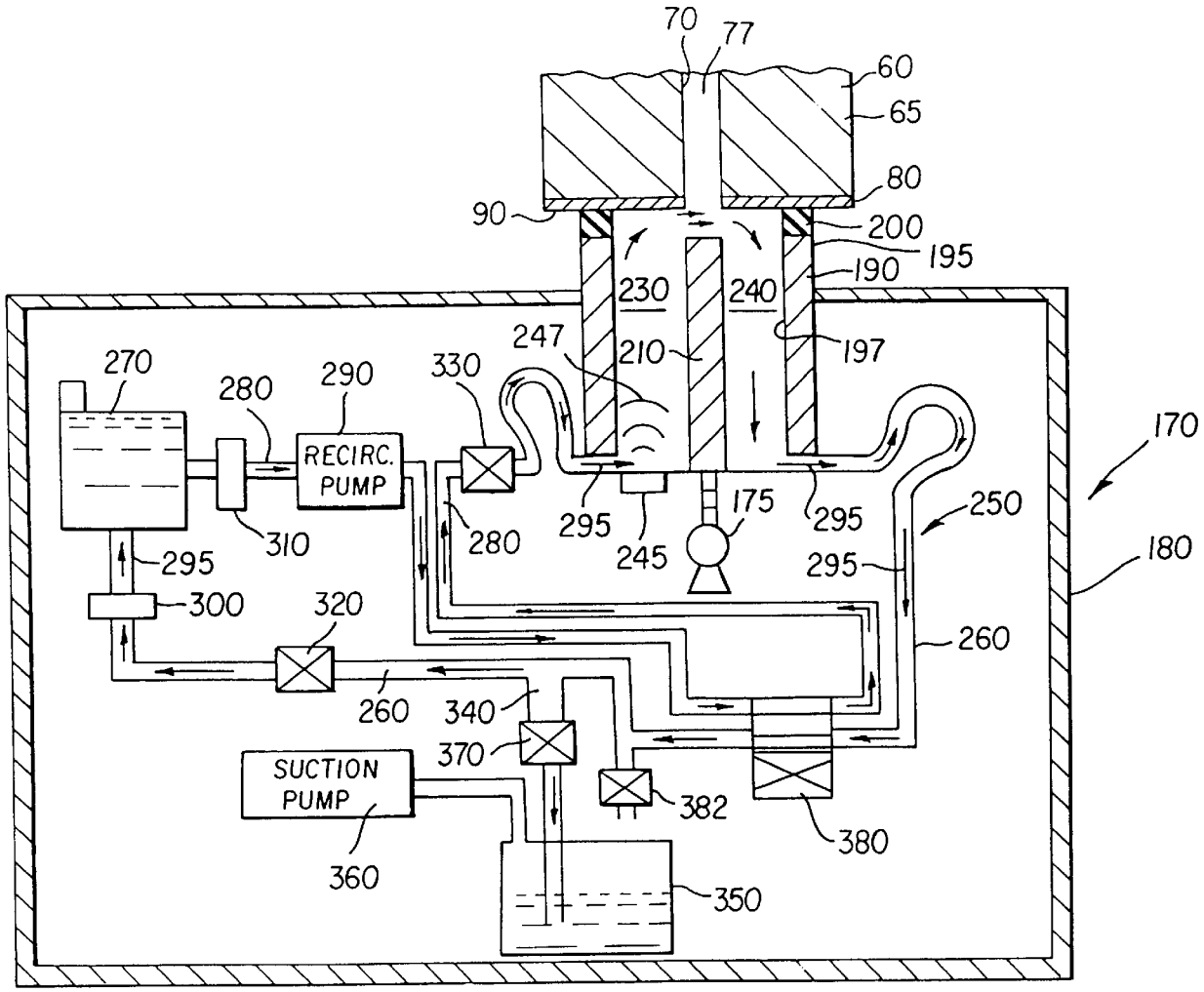
FIG. 5 is a view in vertical section of the cleaning assembly, the cleaning assembly including a septum disposed opposite the orifice so as to define a gap between the orifice and the septum, this view also showing a cleaning liquid flowing in a forward direction and an ultrasonic transducer for inducing pressure waves in the liquid.

As best seen in FIGS. 1 and 5, during forward fluid flow, a first valve 320 is preferably disposed at a predetermined location in first piping segment 260, which first valve 320 is operable to block flow of the liquid through first piping segment 260. Also, a second valve 330 is preferably disposed at a predetermined location in second piping segment 280, which second valve 330 is operable to block flow of the liquid through second piping segment 280. In this regard, first valve 320 and second valve 330 are located in first piping segment 260 and second piping segment 280, respectively, so as to isolate cavity 197 from reservoir 270, for reasons described momentarily. A third piping segment 340 has an open end thereof connected to first piping segment 260 and another open end thereof received into a sump 350. In communication with sump 350 is a suction (i.e., vacuum) pump 360 for reasons described presently. Suction pump 360 drains cup 190 and associated piping of cleaning liquid before cup is detached and returned to first position 172*a*. Moreover, disposed in third piping segment 340 is a third valve 370 operable to isolate piping circuit 250 from sump 350.

Figure 6:
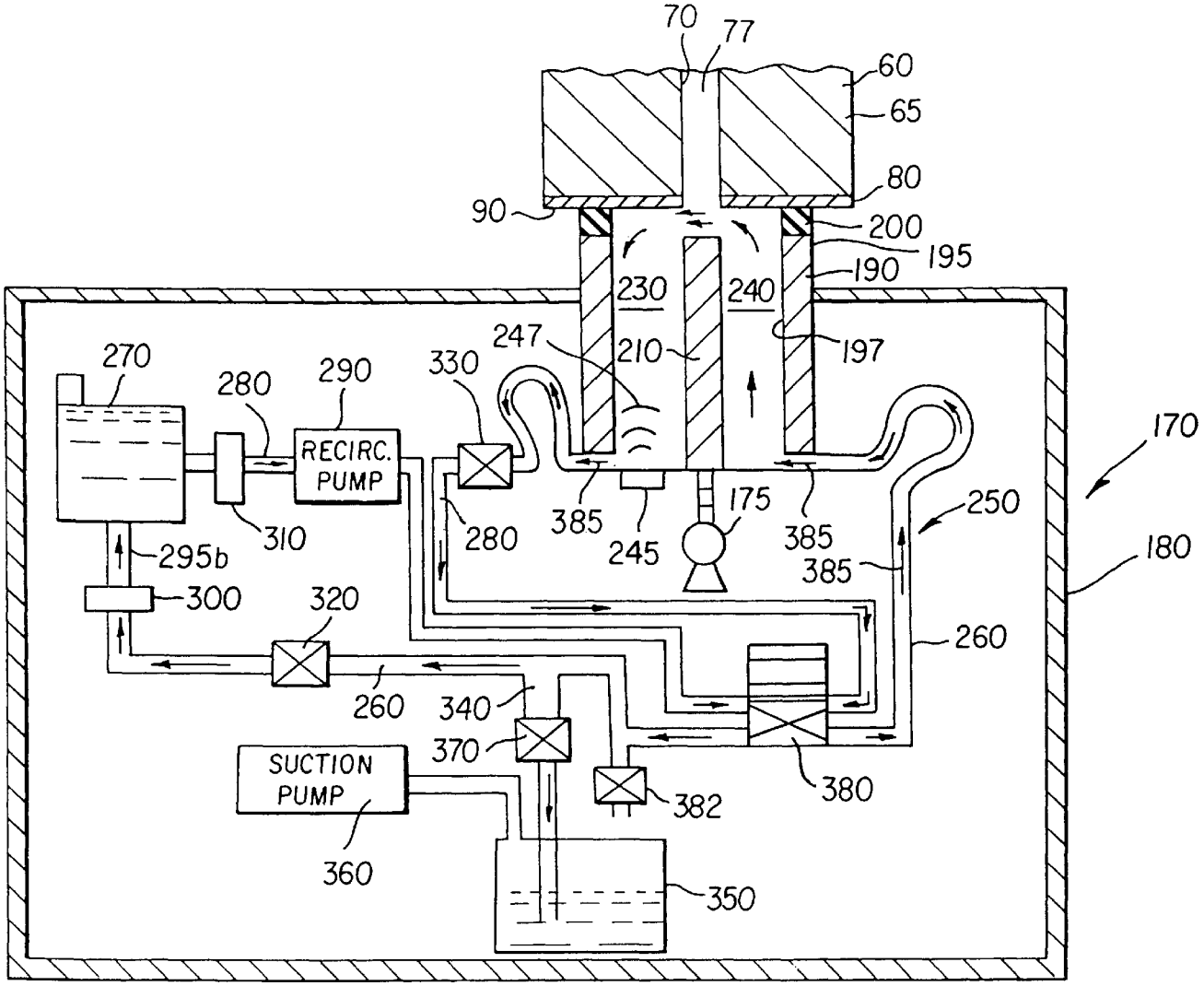
FIG. 6 is a view in vertical section of the cleaning assembly, the cleaning assembly including a septum disposed opposite the orifice so as to define a gap between the orifice and the septum, this view also showing a cleaning liquid flowing in a reverse direction and the ultrasonic transducer for inducing pressure waves in the liquid.

Referring to FIGS. 5 and 6, the present invention also allows reversed flow as well as forward flow of cleaning liquid through cup 190 and gap 220. In this regard, a junction, such as a 4-way valve (e.g., spool valve) 380, is disposed into the piping circuit 260. When the 4-way valve 380 is in a first position (shown in FIG. 5), cleaning liquid flows in a first direction (i.e., forward direction) as illustrated by arrows 295. Thus, 4-way valve 380 may be viewed as a valve system. When 4-way valve 380 is in a second position (shown in FIG. 6), cleaning liquid flows in a second direction (i.e., reverse direction) as illustrated by third arrows 385. Controller 130 may be used to operate 4-way valve 380 in appropriate fashion and also to open an air bleed valve 382 during reverse flow. Forward and reverse flow of cleaning liquid through gap 220 enhances cleaning efficiency. Flow may be reversed a plurality of times depending on amount of cleaning desired. The forward and reverse flow modes of operation described herein may be applied to a so-called "scanning" print head or to the page-width print head 60 described herein. Other methods of accomplishing reversed flow can be used by one skilled in the art based on the teachings herein.

Figure 7:
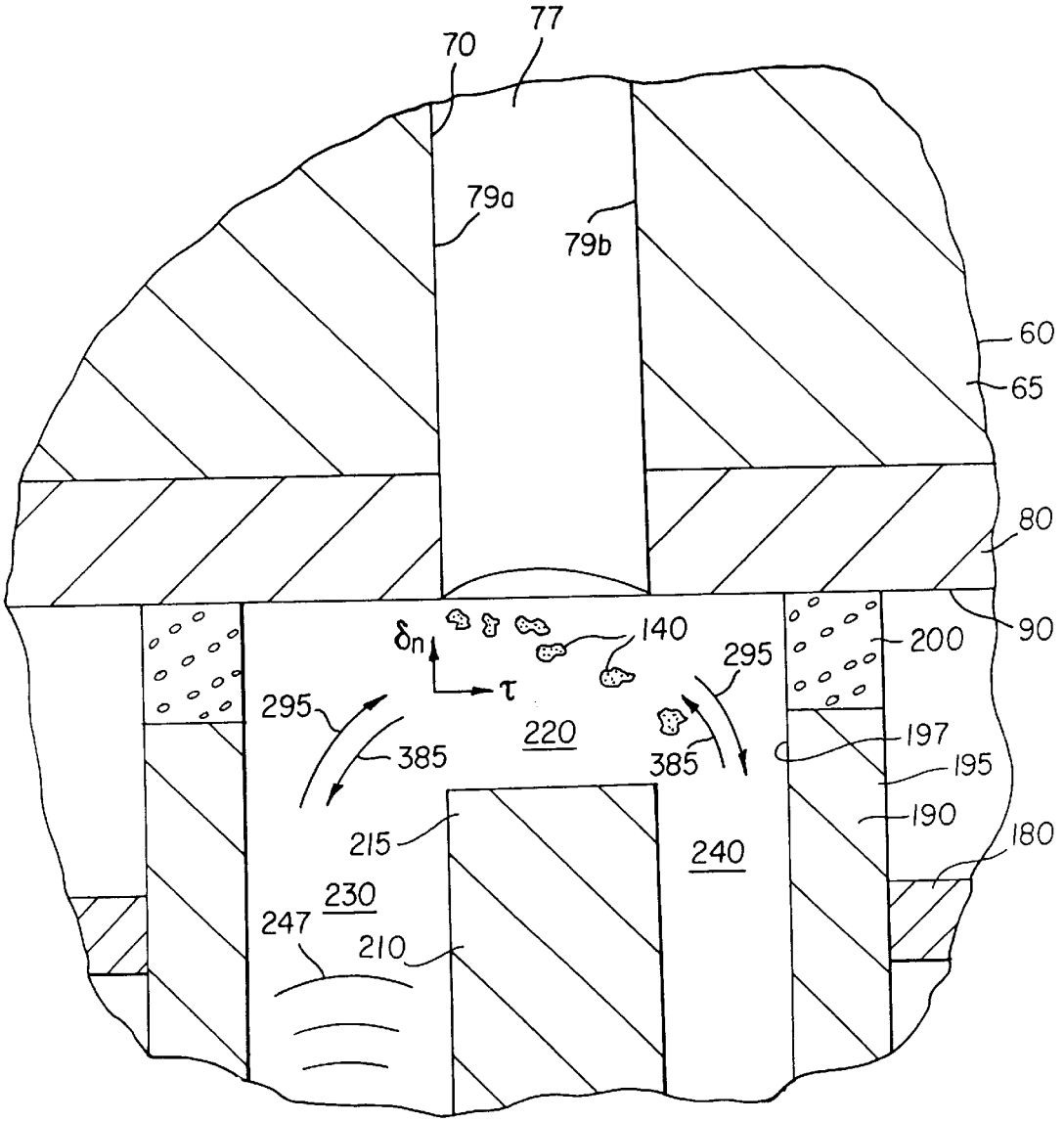
FIG. 7 is an enlarged fragmentation view in vertical section of the cleaning assembly, this view also showing the contaminant being removed from the surface and orifice by a liquid flowing alternately in forward and reverse directions through the gap as the ultrasonic transducer induces pressure waves in the liquid.

Referring to FIGS. 5, 6 and 7, during "forward flow" operation of cleaning assembly 170, first valve 320 and second valve 310 are opened while third valve 370 is closed. Also, 4-way valve 380 is operated to its first position. Recirculation pump 290 is then operated to draw the liquid from reservoir 270 and into first chamber 230. The liquid will then flow through gap 220. However, as the liquid flows through gap 220, a hydrodynamic shearing force will be induced in the liquid due to presence of end portion 215 of septum 210. It is believed this shearing force is in turn caused by a hydrodynamic stress forming in the liquid, which stress has a "normal" component $\delta_n$ acting normal to surface 90 (or orifice 85) and a "shear" component $\tau$ acting along surface 90 (or across orifice 85). Vectors representing the normal stress component $\delta_n$ and the shear stress component $\tau$ are best seen in FIG. 7. The previously mentioned hydrodynamic shearing force acts on contaminant 140 to remove contaminant 140 from surface 90 and/or orifice 85, so that contaminant 140 becomes entrained in the liquid flowing through gap 220. As contaminant 140 is cleaned from surface 90 and orifice 85, the liquid with contaminant 140 entrained therein, flows into second chamber 240 and from there into first piping segment 260. As recirculation pump 290 continues to operate, the liquid with entrained contaminant 140 flows to reservoir 270 from where the liquid is pumped into second piping segment 280. However, it is preferable to remove contaminant 140 from the liquid as the liquid is recirculated through piping circuit 250. This is preferred in order that contaminant 140 is not redeposited onto surface 90 and across orifice 85. Thus, first filter 300 and second filter 310 are provided for filtering contaminant 140 from the liquid recirculating through piping circuit 250. In this manner, 4-way valve 380 is operated to permit forward fluid flow for a predetermined time period. After the predetermined time for forward fluid flow, 4-way valve 380 is then operated in its second position so that fluid flow is in the direction of third arrows 385. After a desired amount of contaminant 140 is cleaned from surface 90 and/or orifice 85, recirculation pump 290 is caused to cease operation and first valve 320 and second valve 330 are closed to isolate cavity 197 from reservoir 270. At this point, third valve 370 is opened and suction pump 360 is operated to substantially suction the liquid from first piping segment 260, second piping segment 280 and cavity 197. This suctioned liquid flows into sump 350 for later disposal. However, the liquid flowing into sump 350 is substantially free of contaminant 140 due to presence of filters 300/310 and thus may be recycled into reservoir 270, if desired.

Figure 8:
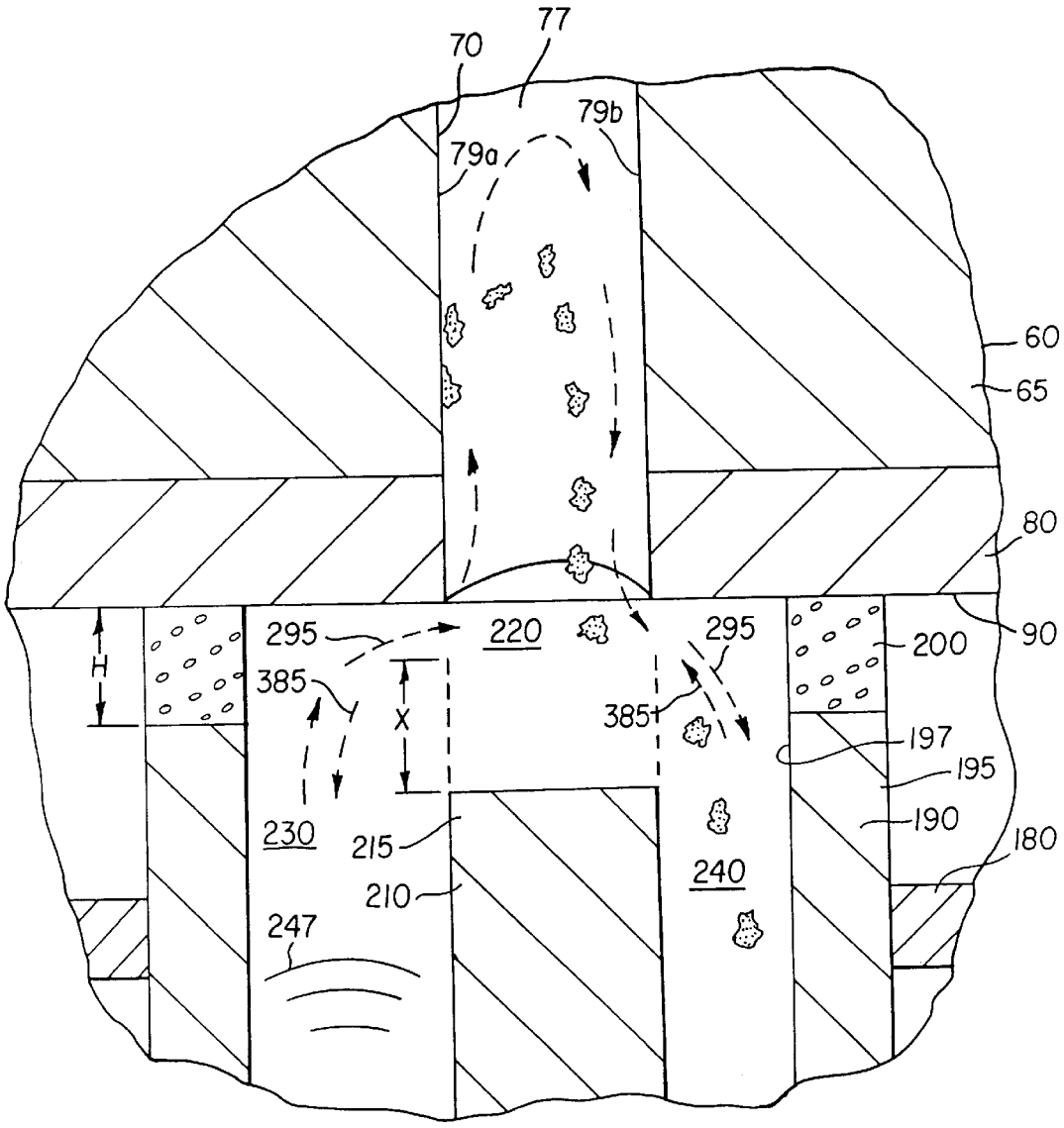
FIG. 8 is an enlarged fragmentation view in vertical section of the cleaning assembly, this view showing the gap having reduced height due to increased length of the septum, for cleaning contaminant from within the ink channel.
Figure 9:
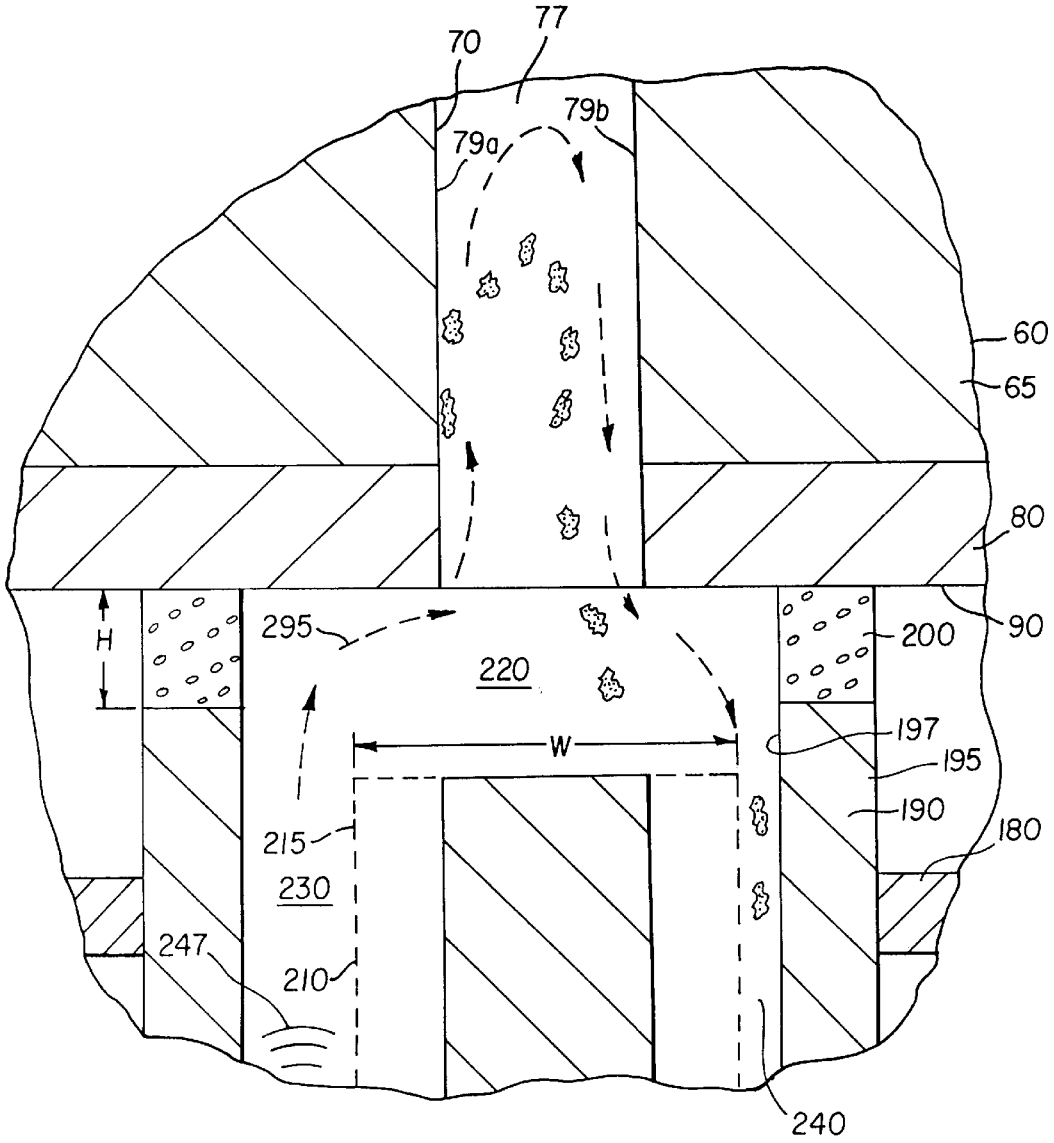
FIG. 9 is an enlarged fragmentation view in vertical section of the cleaning assembly, this view showing the gap having increased width due to increased width of the septum, for cleaning contaminant from within the ink channel.

Referring to FIGS. 8 and 9, it has been discovered that length and width of elongate septum 210 controls amount of hydrodynamic stress acting against surface 90 and orifice 85. This effect is important in order to control severity of cleaning action. Also, it has been discovered that, when end portion 215 of septum 210 is disposed opposite orifice 85, length and width of elongate septum 210 controls amount of penetration (as shown) of the liquid into channel 70. It is believed that control of penetration of the liquid into channel 70 is in turn a function of the amount of normal stress $\delta_n$. However, it has been discovered that the amount of normal stress $\delta_n$ is inversely proportional to height of gap 220. Therefore, normal stress $\delta_n$, and thus amount of penetration of the liquid into channel 70, can be increased by increasing length of septum 210. Moreover, it has been discovered that amount of normal stress $\delta_n$ is directly proportional to pressure drop in the liquid as the liquid slides along end portion 215 and surface 90. Therefore, normal stress $\delta_n$, and thus amount of penetration of the liquid into channel 70, can be increased by increasing width of septum 210. These effects are important in order to clean any contaminant 140 which may be adhering to either of side walls 79*a* or 79*b*. More specifically, when elongate septum 210 is fabricated so that it has a greater than nominal length X, height of gap 220 is decreased to enhance the cleaning action, if desired. Also, when elongate septum 210 is fabricated so that it has a greater than nominal width W, the run of gap 220 is increased to enhance the cleaning action, if desired. Thus, a person of ordinary skill in the art may, without undue experimentation, vary both the length X and width W of septum 210 to obtain an optimum gap size for obtaining optimum cleaning depending on the amount and severity of contaminant encrustation. It may be appreciated from the discussion hereinabove, that a height H of seal 200 also may be varied to vary size of gap 220 with similar results.

Returning to FIG. 1, elevator 175 may be connected to cleaning cup 190 for elevating cup 190 so that seal 200 sealingly engages surface 90 when print head 60 is at second position 172*b*. To accomplish this result, elevator 175 is connected to controller 130, so that operation of elevator 175 is controlled by controller 130. Of course, when the cleaning operation is completed, elevator 175 may be lowered so that seal 200 no longer engages surface 90.

As best seen in FIG. 1, in order to clean the page-width print head 60 using cleaning assembly 170, platen roller 40 has to be moved to make room for cup 190 to engage print head 60. An electronic signal from controller 130 activates a motorized mechanism (not shown) that moves platen roller 40 in direction of first double-ended arrow 387 thus making room for upward movement of cup 190. Controller 130 also controls elevator 175 for transporting cup 190 from first position 172*a* not engaging print head 60 to second position 172*b* (shown in phantom) engaging print head 60. When cup 190 engages print head cover plate 80, cleaning assembly 170 circulates liquid through cleaning cup 190 and over print head cover plate 80. When print head 60 is required for printing, cup 190 is retracted into housing 180 by elevator 175 to its resting first position 172*a*. The cup 190 may be advanced outwardly from and retracted inwardly into housing 180 in direction of second double-ended arrow 388.

The mechanical arrangement described above is but one example. Many different configurations are possible. For example, print head 60 may be rotated outwardly about a horizontal axis 389 to a convenient position to provide clearance for cup 190 to engage print head cover plate 80.

Referring to FIGS. 5, 6, 7, 8 and 9, in communication with the liquid in cavity 197 is a pressure pulse generator, such as the previously mentioned ultrasonic generator 245, capable of generating a plurality of the pressure waves 247 (i.e., ultrasonic vibrations) in the liquid. Pressure waves 247 impact contaminant 140 to dislodge contaminant 140 from surface 90 and/or orifice 85. It is believed pressure waves 247 accomplish this result by adding kinetic energy to the liquid along a vector directed substanially normal to surface 90 and orifices 85. Of course, the liquid is substantially incompressible; therefore, pressure waves 247 propagate in the liquid in order to reach contaminate 140. By way of example only, and not by way of limitation, pressure waves 247 may have a frequency of aproximately 17,000 KHz and above.

Figure 10:
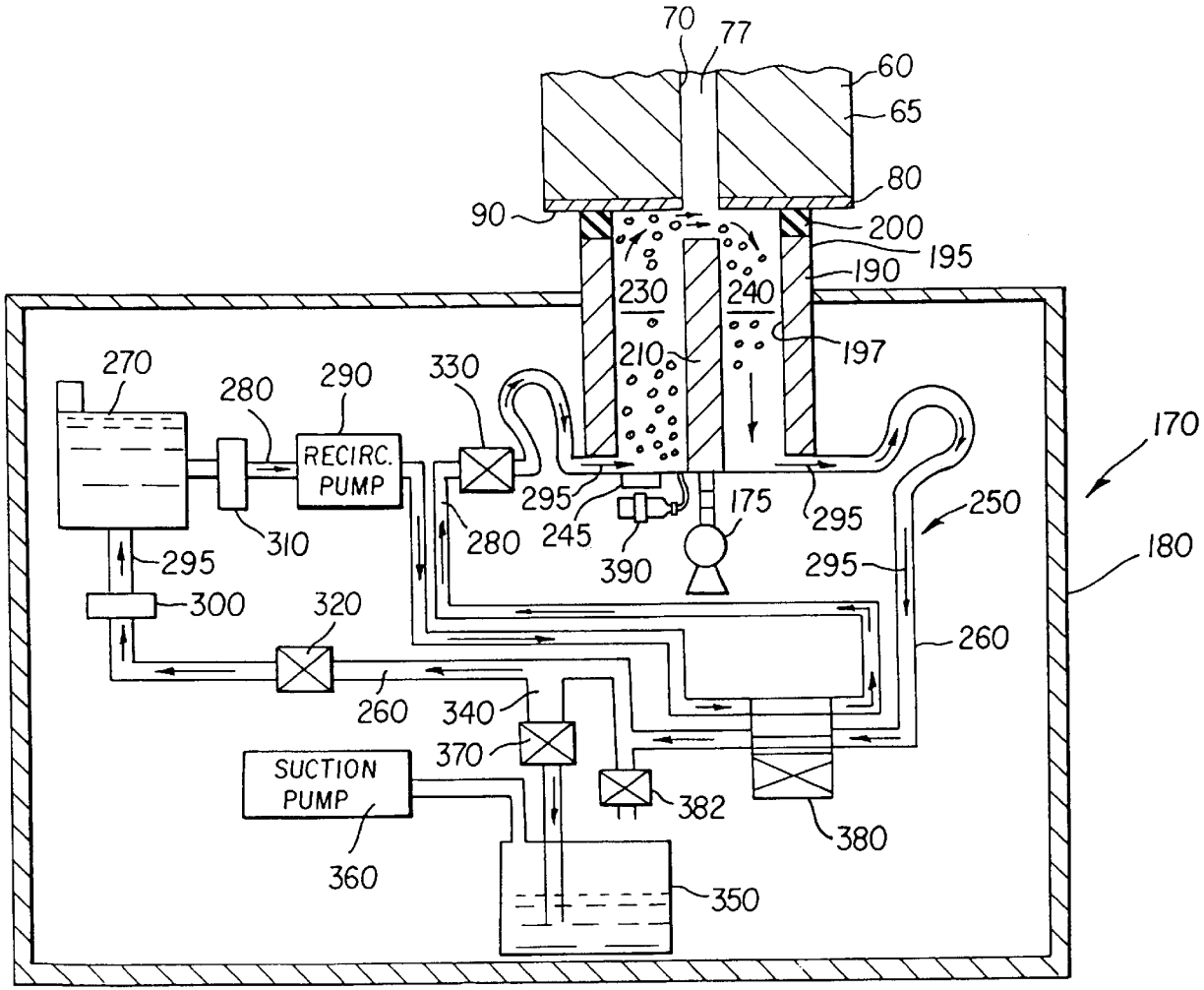
FIG. 10 is a view in vertical section of a second embodiment of the invention, wherein the cleaning assembly includes a pressurized gas supply in fluid communication with the gap for introducing gas bubbles into the liquid in the gap, this view also showing the liquid flowing in the forward direction as the ultrasonic transducer induces pressure waves in the liquid.
Figure 11:
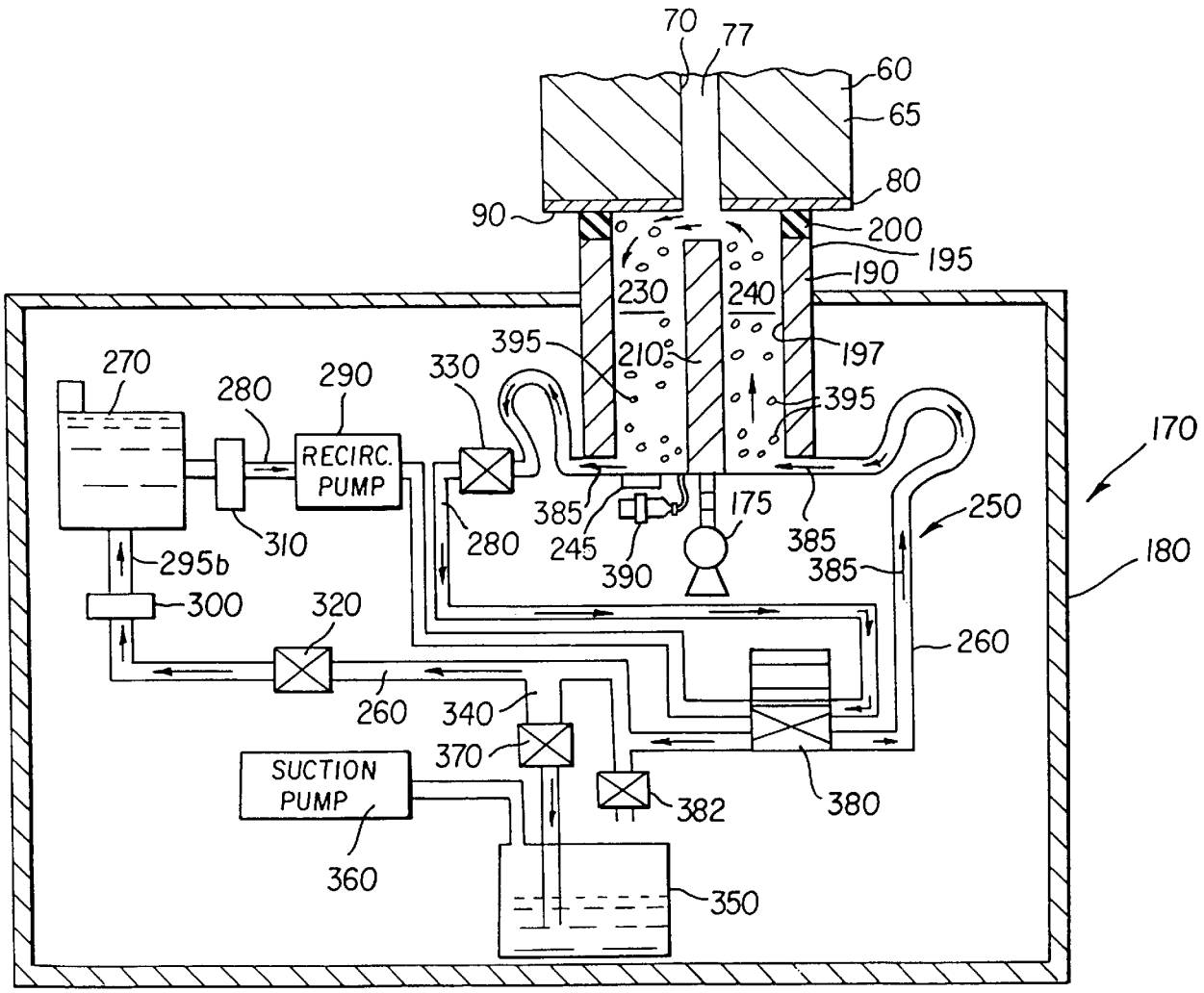
FIG. 11 is a view in vertical section of the second embodiment of the invention, wherein the cleaning assembly includes a pressurized gas supply in fluid communication with the gap for introducing gas bubbles into the liquid in the gap, this view showing the liquid flowing in the reverse direction as the ultrasonic transducer induces pressure waves in the liquid.

Referring to FIGS. 10 and 11, there is shown a second embodiment of the present invention. In this second embodiment of the invention, a pressurized gas supply 390 is in communication with gap 220 for injecting a pressurized gas into gap 220. The gas will form a multiplicity of gas bubbles 395 in the liquid to enhance cleaning of contaminant 140 from surface 90 and/or orifice 85.

Figure 12:
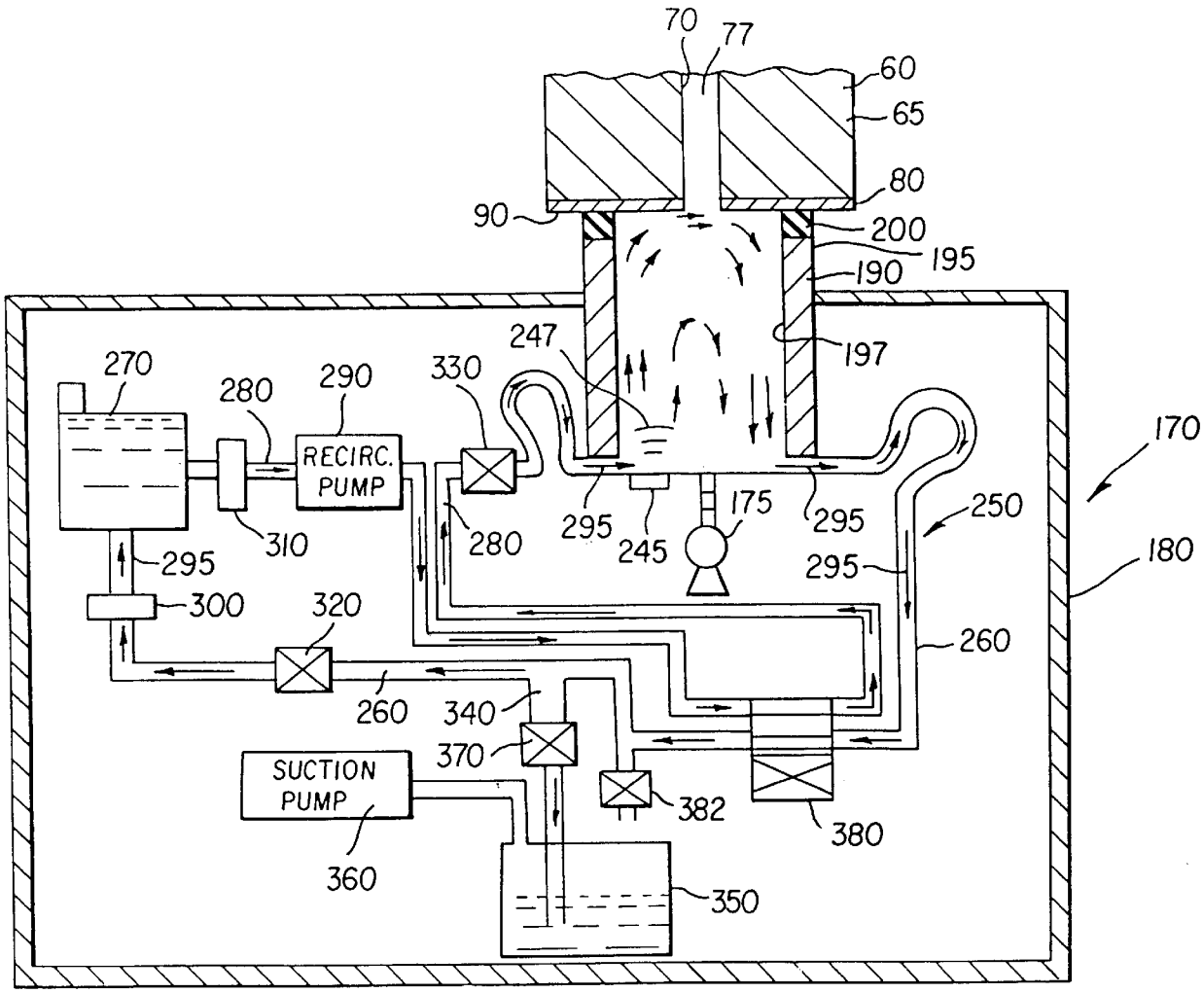
FIG. 12 is a view in vertical section of a third embodiment of the invention, wherein the septum is absent for increasing size of the gap to its maximum extent, this view also showing the liquid flowing in the forward direction as the ultrasonic transducer induces pressure waves in the liquid.
Figure 13:
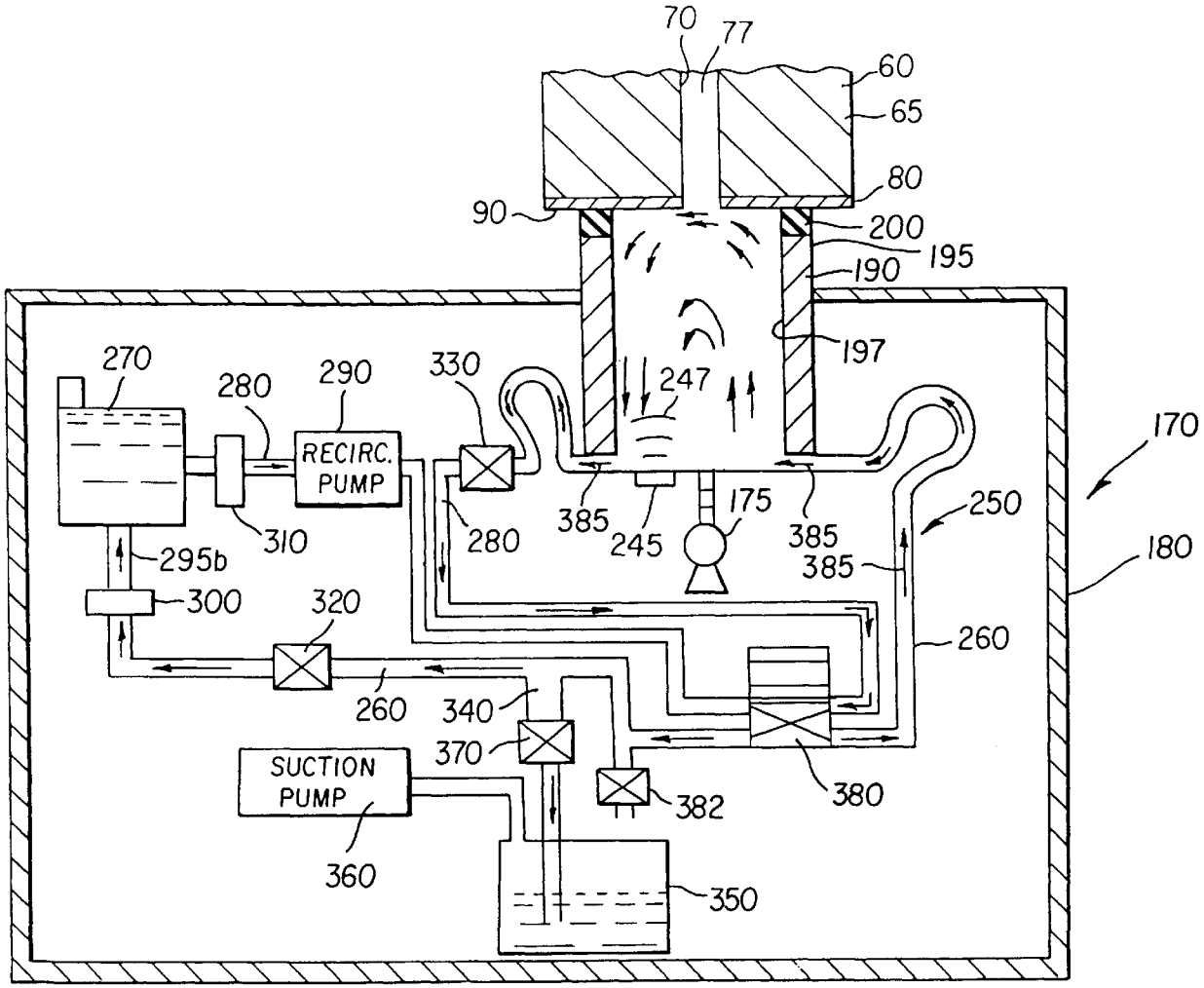
FIG. 13 is a view in vertical section of the third embodiment of the invention, wherein the septum is absent for increasing size of the gap to its maximum extent, this view showing the liquid flowing in the reverse direction as the ultrasonic transducer induces pressure waves in the liquid.

Referring to FIGS. 12 and 13, there is shown a third embodiment of the present invention. In this third embodiment of the invention, septum 210 is absent and contaminant 140 is cleaned from surface 90 and/or orifice 85 without need of septum 210. In this case, gap 220 is sized to its maximum extent, due to absence of septum 210, to allow a minimum amount of shear force to act against contaminant 140. This embodiment of the invention is particularly useful when there is a minimum amount of contaminant present or when it is desired to exert a minimum amount of shear force against surface 90 and/or orifice 85 to avoid possible damage to surface 90 and/or orifice 85.

Figure 14:
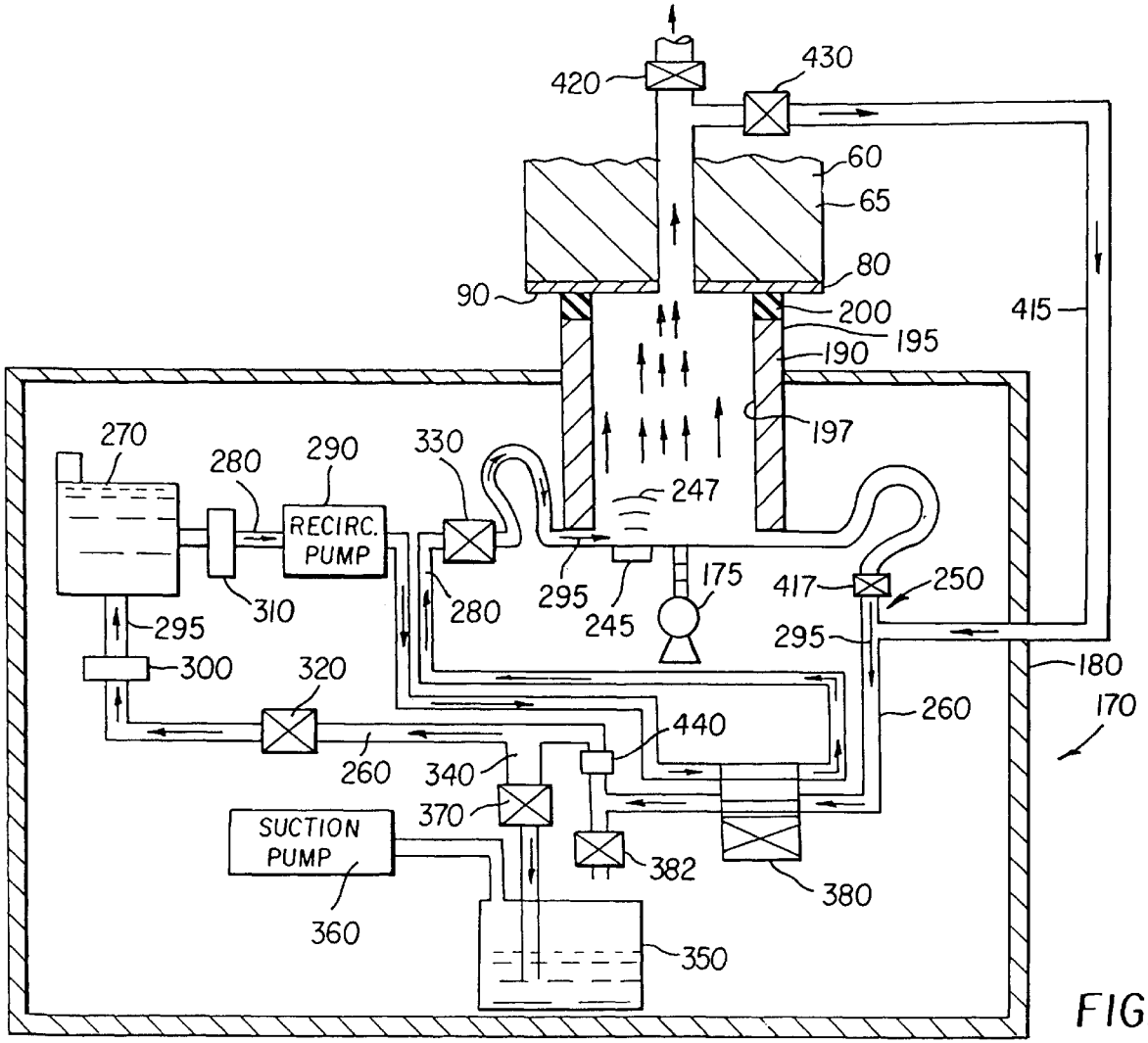
FIG. 14 is a view in vertical section of a fourth embodiment of the invention, wherein the septum is absent and flow of cleaning liquid is directed into the channel through the orifice while the liquid flows in the forward direction and while the ultrasonic transducer induces pressure waves in the liquid.

Referring to FIG. 14, there is shown a fourth embodiment of the present invention operating in "forward flow" mode. Although this fourth embodiment is shown operating in "forward flow" mode, it may be appreciated that this fourth embodiment can operate in "reverse flow" mode, as well. In this fourth embodiment of the invention, septum 210 is absent and contaminant 140 is cleaned from side walls 79*a*/*b* of channel 70 without need of septum 210. In this case, piping circuit 250 comprises a flexible fourth piping segment 415 (e.g., a flexible hose) interconnecting channel 70 and first piping segment 260. In this regard, fourth piping segment 415 is sufficiently long and flexible to allow unimpeded motion of print head 60 during printing. According to this fourth embodiment of the invention, piping circuit 250 includes a fourth valve 417 disposed in first piping segment 260 and a fifth valve 420 is in communication with channel 70. In addition, a sixth valve 430 is disposed in fourth piping segment 415 between fifth valve 420 and first piping segment 260. During operation, fourth valve 417, third valve 330 and fifth valve 420 are closed while sixth valve 430 and second valve 330 are opened. Recirculation pump 290 is then operated to pump the cleaning liquid into cavity 197. The cleaning liquid is therefore circulated in the manner shown by the plurality of second arrows 295. The liquid exiting through sixth valve 430 is transported through fourth piping segment 415.

Still referring to FIG. 14, the liquid emerging through sixth valve 430 initially will be contaminated with contaminant 140. It is desirable to collect this liquid in sump 350 rather than to recirculate the liquid. Therefore, this contaminated liquid is directed to sump 350 by closing second valve 330 and opening third valve 370 while suction pump 360 operates. The liquid will then be free of contaminant 140 and may be recirculated by closing third valve 370 and opening second valve 330. A detector 440 is disposed in first piping segment 260 to determine when the liquid is clean enough to be recirculated. Information from detector 440 can be processed and used to activate the valves in order to direct exiting liquid either into sump 350 or into recirculation. In this regard, detector 440 may be a spectrophotometric detector. In any event, at the end of the cleaning procedure, suction pump 360 is activated and third valve 370 is opened to suction into sump 350 any trapped liquid remaining between second valve 330 and first valve 320. This process prevents spillage of liquid when cleaning assembly 170 is detached from cover plate 80. Further, this process causes cover plate 80 to be substantially dry, thereby permitting print head 60 to function without impedance from cleaning liquid drops being around orifices 85. To resume printing, sixth valve 430 is closed and fifth valve 420 is opened to prime channel 70 with ink. Suction pump 360 is again activated, and third valve 370 is opened to suction any liquid remaining in cup 190. Alternatively, the cup 190 may be detached and a separate spittoon (not shown) may be brought into alignment with print head 60 to collect drops of ink that are ejected from channel 70 during priming of print head 60.

The cleaning liquid may be any suitable liquid solvent composition, such as water, isopropanol, diethylene glycol, diethylene glycol monobutyl ether, octane, acids and bases, surfactant solutions and any combination thereof. Complex liquid compositions may also be used, such as microemulsions, micellar surfactant solutions, vesicles and solid particles dispersed in the liquid.

It may be appreciated from the description hereinabove, that an advantage of the present invention is that the cleaning assembly belonging to the invention directly and effectively cleans print head surface 90, ink droplet orifices 85 and ink channels 70. This is so because septum 210 induces shear stress in the liquid that flows through gap 220 to clean contaminant 140 from surface 90 and/or orifice 85 and also ink channels 70. This is also true because operation of 4-way valve 380 induces to-and-fro motion of the cleaning fluid in the gap, thereby agitating the liquid coming into contact with contaminant 140. Agitation of the liquid in this manner in turn agitates contaminant 140 in order to loosen contaminant 140. This is so whether contaminant 140 is on surface 90, partially or completely covering orifice 85 or located in ink channels 70. Also, use of ultrasonic transducer 245 further enhances cleaning effectiveness due to action of pressure waves 247 that are induced in the liquid by ultrasonic transduer 245.

While the invention has been described with particular reference to its preferred embodiments, it will be understood by those skilled in the art that various changes may be made and equivalents may be substituted for elements of the preferred embodiments without departing from the invention. In addition, many modifications may be made to adapt a particular situation and material to a teaching of the present invention without departing from the essential teachings of the invention. For example, a heater may be disposed in reservoir 270 to heat the liquid therein for enhancing cleaning of surface 90, channel 70 and/or orifice 85. This is particularly useful when the cleaning liquid is of a type that increases in cleaning effectiveness as temperature of the liquid is increased. As another example, in the case of a multiple color printer having a plurality of print heads corresponding to respective ones of a plurality of colors, one or more dedicated cleaning assemblies per color might be used to avoid cross-contamination of print heads by inks of different colors. As yet another example, a contamination sensor may be connected to cleaning assembly 170 for detecting when cleaning is needed. In this regard, such a contamination sensor may a pressure transducer in fluid communication with ink in channels 70 for detecting rise in ink back pressure when partially or completely blocked channels 70 attempt to eject ink droplets 100. Such a contamination sensor may also be a flow detector in communication with ink in channels 70 to detect low ink flow when partially or completely blocked channels 70 attempt to eject ink droplets 100. Such a contamination sensor may also be an optical detector in optical communication with surface 90 and orifices 85 to optically detect presence of contaminant 140 by means of reflection or emissivity. Such a contamination sensor may further be a device measuring amount of ink released into a spittoon-like container during predetermined periodic purging of channels 70. In this case, the amount of ink released into the spittoon-like container would be measured by the device and compared against a known amount of ink that should be present in the spittoon-like container if no orifices were blocked by contaminant 140.

Therefore, what is provided is a self-cleaning printer with reverse fluid flow and ultrasonics and method of assembling the printer.

PARTS LIST

H . . . height of seal
W . . . greater width of fabricated septum
X . . . greater length of fabricated septum
10 . . . printer
20 . . . image
30 . . . receiver
40 . . . platen roller
50 . . . platen roller motor
55 . . . first arrow
60 . . . print head
65 . . . print head body
70 . . . channel
75 . . . channel outlet
77 . . . ink body
79*a*/*b* . . . side walls
80 . . . cover plate
85 . . . orifice
90 . . . surface
100 . . . ink droplet
107 . . . first axis
109 . . . ink supply container
110 . . . ink pressure regulator
120 . . . paper transport control system
130 . . . controller
140 . . . contaminant
145 . . . second axis
170 . . . cleaning assembly
172*a* . . . first position (of cleaning assembly)
172*b* . . . second position (of cleaning assembly)
175 . . . elevator
180 . . . housing
190 . . . cup
195 . . . open end (of cup)
197 . . . cavity
200 . . . seal
210 . . . septum
215 . . . end portion (of septum)
220 . . . gap
230 . . . first chamber
240 . . . second chamber
245 . . . ultrasonic transducer
247 . . . pressure waves
250 . . . piping circuit
260 . . . first piping segment
270 . . . reservoir
280 . . . second piping segment
290 . . . recirculation pump
295 . . . second arrows
300 . . . first filter
310 . . . second filter
320 . . . first valve
330 . . . second valve
340 . . . third piping segment
350 . . . sump
360 . . . suction pump
370 . . . third valve
380 . . . 4-way valve
382 . . . air bleed valve
385 . . . third arrows
387 . . . first double-headed arrow
388 . . . second double-headed arrow
389 . . . horizontal plane
390 . . . gas supply
395 . . . gas bubbles
400 . . . piston arrangement
410 . . . piston
415 . . . fourth piping segment
417 . . . fourth valve
420 . . . fifth valve
430 . . . sixth valve
440 . . . detector

What is claimed is:

1. A self-cleaning printer, comprising:

(a) a print head having a surface thereon;

(b) a structural member disposed opposite the surface for defining a gap therebetween sized to allow a flow of fluid in a first direction through the gap, the size of the gap controlling hydrodynamic pressure and acceleration of the fluid through the gap to induce a shearing force in the fluid, whereby the shearing force acts against the surface while the shearing force is induced in the fluid;

(c) a junction coupled to the gap for changing flow of the fluid from the first direction to a second direction opposite the first direction, whereby the fluid is agitated while the fluid changes from the first direction to the second direction; and (d) a pressure pulse generator in fluid communication with the fluid for generating a pressure wave propagating in the fluid and acting against the surface, whereby the surface is cleaned while the shearing force and the pressure wave act against the surface and while the fluid is agitated.

2. The self-cleaning printer of claim 1, further comprising a pump in fluid communication with the gap for pumping the fluid through the gap.

3. The self-cleaning printer of claim 1, further comprising a gas supply in fluid communication with the gap for injecting a gas into the gap to form a gas bubble in the fluid for enhancing cleaning of the surface.

4. A self-cleaning printer, comprising:

(a) a print head having a surface susceptible to having contaminant thereon; and (b) a cleaning assembly disposed relative to the surface for directing a flow of fluid in a first direction along the surface to clean the contaminant from the surface, said assembly including:

(i) a septum disposed opposite the surface for defining a gap therebetween sized to allow the fluid through the gap, the size of the gap controlling hydrodynamic pressure and acceleration of the fluid through the gap to induce a hydrodynamic shearing force in the fluid, whereby the shearing force acts against the contaminant while the shearing force is induced in the fluid;

(ii) a valve in fluid communication with the gap for changing flow of the fluid from the first direction to a second direction opposite the first direction, whereby the contaminant is agitated while the fluid changes from the first direction to the second direction; and (iii) an ultrasonic transducer in fluid communication with the fluid for generating a pressure wave propagating in the fluid and acting against the contaminant, whereby the surface is cleaned of the contaminant while the shearing force and the pressure wave act against the contaminant and while the contaminant is agitated.

5. The self-cleaning printer of claim 4, further comprising a pump in fluid communication with the gap for pumping the fluid and contaminant from the gap.

6. The self-cleaning printer of claim 4, further comprising a pressurized gas supply in fluid communication with the gap for injecting a pressurized gas into the gap to form a plurality of gas bubbles in the fluid for enhancing cleaning of the contaminant from the surface.

7. The self-cleaning printer of claim 6, further comprising a closed-loop piping circuit in fluid communication with the gap for recycling the liquid through the gap.

8. The self-cleaning printer of claim 7, wherein said piping circuit comprises:

(a) a first piping segment in fluid communication with the first chamber; and (b) a second piping segment coupled to said first piping segment, said second piping segment in fluid communication with the second chamber and connected to said pump, whereby said pump pumps the liquid and entrained contaminant from the gap, into the second chamber, through said second piping segment, through said first piping segment, into the first chamber and back into the gap.

9. The self-cleaning printer of claim 8, further comprising:

(a) a first valve connected to said first piping segment and operable to block the flow of liquid through said first piping segment;

(b) a second valve connected to said second piping segment and operable to block the flow of liquid through said second piping segment; and (c) a suction pump interposed between said first valve and said second valve for suctioning the liquid and entrained contaminant from said first piping segment and said second piping segment while said first valve blocks the first piping segment and while said second valve blocks said second piping segment.

10. The self-cleaning printer of claim 9, further comprising a sump connected to said suction pump for receiving the liquid and contaminant suctioned by said suction pump.

11. The self-cleaning printer of claim 6, further comprising an elevator connected to said cleaning assembly for elevating said cleaning assembly into engagement with the surface of said print head, said elevator connected to said controller, so that operation of said elevator is controlled by said controller.

12. The self-cleaning printer of claim 7, further comprising a filter connected to said piping circuit for filtering the contaminant from the liquid.

13. A self-cleaning printer, comprising:

(a) a print head having a surface defining an orifice therethrough, the orifice susceptible to contaminant obstructing the orifice;

(b) a cleaning assembly disposed proximate the surface for directing a flow of liquid in a first direction along the surface and across the orifice to clean the contaminant from the orifice, said assembly including:

(i) a cup sealingly surrounding the orifice, said cup defining a cavity therein;

(ii) an elongate septum disposed in said cup perpendicularly opposite the orifice for defining a gap between the orifice and said septum, the gap sized to allow the liquid through the gap, said septum dividing the cavity into a first chamber and a second chamber each in communication with the gap, the size of the gap controlling hydrodynamic pressure and acceleration of the liquid through the gap to induce a hydrodynamic shearing force in the liquid, whereby the shearing force acts against the contaminant while the shearing force is induced in the liquid;

(iii) a valve system in fluid communication with the gap for changing flow of the liquid from the first direction to a second direction opposite the first direction to agitate the contaminant;

(iv) an ultrasonic transducer in fluid communication with the liquid for generating a pressure wave propagating in the liquid and acting against the contaminant, whereby the contaminant is entrained in the liquid while the shearing force and the pressure wave act against the contaminant and while the contaminant is agitated and whereby the surface is cleaned of the contaminant while the contaminant is entrained in the liquid;

(v) a pump in fluid communication with the second chamber for pumping the liquid and entrained contaminant from the gap and into the second chamber; and (c) a controller connected to said cleaning assembly and said print head for controlling operation thereof.

14. The self-cleaning printer of claim 13, further comprising a pressurized gas supply in fluid communication with the gap for injecting a pressurized gas into the gap to form a multiplicity of gas bubbles in the liquid for enhancing cleaning of the contaminant from the orifice.

15. A self-leaning printer, comprising:

(a) a print head having a surface defining an orifice therethrough, the orifice susceptible to contaminant obstructing the orifice;

(b) a cleaning assembly disposed proximate the surface for directing a flow of liquid in a first direction along the surface and across the orifice to clean the contaminant from the orifice, said assembly including:

(i) a cup sealingly surrounding the orifice, said cup defining a cavity therein sized to allow the liquid to flow through the cavity, the liquid being accelerated while the liquid flows through the cavity in order to induce a hydrodynamic shearing force in the liquid, whereby the shearing force acts against the contaminant while the shearing force is induced in the liquid, whereby the contaminant is cleaned from the orifice while the shearing force acts against the contaminant and whereby the contaminant is entrained in the liquid while the contaminant is cleaned from the orifice;

(ii) a valve system in fluid communication with the gap for changing flow of the liquid from the first direction to a second direction opposite the first direction;

(iii) an ultrasonic transducer in fluid communication with the liquid for generating a pressure wave propagating in the liquid and acting against the contaminant, whereby the contaminant is entrained in the liquid while the shearing force and pressure wave act against the contaminant and while the contaminant is agitated and whereby the surface is cleaned of the contaminant while the contaminant is entrained in the liquid;

(iv) a pump in fluid communication with the cavity for pumping the liquid and entrained contaminant from the cavity; and (c) a controller connected to said cleaning assembly and said print head for controlling operation thereof.

16. A method of assembling a self-cleaning printer, comprising the steps of:

(a) disposing a structural member opposite a surface of a print head for defining a gap therebetween sized to allow a flow of fluid in a first direction through the gap, the the size of the gap controlling hydrodynamic pressure and acceleration of the fluid through the gap to induce a shearing force in the fluid, whereby the shearing force acts against the surface while the shearing force is induced in the fluid and whereby the surface is cleaned while the shearing force acts against the surface;

(b) coupling a junction to the gap for changing flow of the fluid from the first direction to a second direction opposite the first direction, whereby the fluid is agitated while the flow of fluid changes from the first direction to the second direction; and (c) disposing a pressure pulse generator in fluid communication with the fluid for generating a pressure wave propagating in the fluid and acting against the surface, whereby the surface is cleaned while the shearing force and pressure wave act against the surface and while the fluid is agitated.

17. The method of claim 16, further comprising the step of disposing a pump in fluid communication with the gap for pumping the fluid through the gap.

18. The method of claim 16, further comprising the step of disposing a gas supply in fluid communication with the gap for injecting a gas into the gap to form a gas bubble in the flow of fluid for enhancing cleaning of the surface.

19. A method of assembling a self-cleaning printer, comprising the steps of:

(a) disposing a cleaning assembly relative to a surface of a print head for directing a flow of fluid along the surface to clean a contaminant from the surface, the assembly including a septum disposed opposite the surface for defining a gap therebetween sized to allow the flow of fluid through the gap, the the size of the gap controlling hydrodynamic pressure and acceleration of the fluid through the gap to induce a hydrodynamic shearing force in the fluid, whereby the shearing force acts against the contaminant while the shearing force is induced in the fluid;

(b) providing a valve to be disposed in fluid communication with the gap for changing flow of the fluid from the first direction to a second direction opposite the first direction to agitate the contaminant; and (c) disposing an ultrasonic transducer in fluid communication with the fluid for generating a pressure wave propagating in the fluid and acting against the contaminant, whereby the surface is cleaned of the contaminant while the shearing force and pressure wave act against the contaminant and while the contaminant is agitated.

20. The method of claim 19, further comprising the step of disposing a pump in fluid communication with the gap for pumping the fluid and contaminant from the gap.

21. The method of claim 19, further comprising the step of disposing a pressurized gas supply in fluid communication with the gap for injecting a pressurized gas into the gap to form a plurality of gas bubbles in the fluid for enhancing cleaning of the contaminant from the surface.

22. The method of claim 21, further comprising the step of disposing a closed-loop piping circuit in fluid communication with the gap for recycling the liquid through the gap.

23. The method of claim 22, wherein the step of disposing the piping circuit comprises the steps of:

(a) disposing a first piping segment in fluid communication with the first chamber; and (b) coupling a second piping segment to the first piping segment, the second piping segment in fluid communication with the second chamber and connected to the pump, whereby the pump pumps the liquid and entrained contaminant from the gap, into the second chamber, through the second piping segment, through the first piping segment, into the first chamber and back into the gap.

24. The method of claim 23, further comprising the steps of:

(a) connecting a first valve to the first piping segment, the first valve being operable to block the flow of liquid through the first piping segment;

(b) connecting a second valve to the second piping segment, the second valve being operable to block the flow of liquid through the second piping segment; and (c) interposing a suction pump between the first valve and the second valve for suctioning the liquid and entrained contaminant from the first piping segment and the second piping segment while the first valve blocks the first piping segment and while the second valve blocks the second piping segment.

25. The method of claim 24, further comprising the step of connecting a sump to the suction pump for receiving the liquid and contaminant suctioned by the suction pump.

26. The method of claim 22, further comprising the step of connecting a filter to the piping circuit for filtering the contaminant from the liquid.

27. The method of claim 21, further comprising the steps of connecting an elevator to the cleaning assembly for elevating the cleaning assembly into engagement with the surface of the print head, and connecting said elevator to said controller, so that operation of said elevator is controlled by said controller.

28. A method of assembling a self-cleaning printer, comprising the steps of:

(a) providing a print head, the print head having a surface defining an orifice therethrough, the orifice susceptible to contaminant obstructing the orifice;

(b) disposing a cleaning assembly proximate the surface for directing a flow of liquid in a first direction along the surface and across the orifice to clean the contaminant from the orifice, the step of disposing a cleaning assembly including the steps of:

(i) providing a cup for sealingly surrounding the orifice, the cup defining a cavity therein;

(ii) disposing an elongate septum in the cup perpendicularly opposite the orifice for defining a gap between the orifice and the septum, the gap sized to allow the liquid through the gap, the septum dividing the cavity into a first chamber and a second chamber each in communication with the gap, the the size of the gap controlling hydrodynamic pressure and acceleration of the liquid through the gap to induce a hydrodynamic shearing force in the liquid, whereby the shearing force acts against the contaminant while the shearing force is induced in the flow of liquid;

(iii) providing a valve system to be disposed in fluid communication with the gap for changing flow of the liquid from the first direction to a second direction opposite the first direction;

(iv) disposing an ultrasonic transducer in fluid communication with the liquid for generating a pressure wave propagating in the liquid and acting against the contaminant, whereby the contaminant is entrained in the liquid while the shearing force and pressure wave act against the contaminant and while the contaminant is agitated and whereby the surface is cleaned of the contaminant while the contaminant is entrained in the liquid;

(v) disposing a pump in fluid communication with the second chamber for pumping the liquid and entrained contaminant from the gap and into the second chamber; and (c) connecting a controller to the cleaning assembly and the print head for controlling operation thereof.

29. The method of claim 28, further comprising the step of disposing a pressurized gas supply in fluid communication with the gap for injecting a pressurized gas into the gap to form a multiplicity of gas bubbles in the flow of liquid for enhancing cleaning of the contaminant from the orifice.

30. A method of assembling a self-cleaning printer, comprising the steps of:

(a) providing a movable print head, the print head having a surface defining an orifice therethrough, the orifice having contaminant obstructing the orifice;

(b) disposing a cleaning assembly proximate the surface for directing a flow of liquid in a first direction along the surface and across the orifice to clean the contaminant from the orifice, the step of disposing a cleaning assembly including the steps of:

(i) providing a cup for sealingly surrounding the orifice, the cup defining a cavity therein sized to allow the liquid through the cavity, liquid being accelerated while the liquid flows through the cavity in order to induce a hydrodynamic shearing force in the liquid, whereby the shearing force acts against the contaminant while the shearing force is induced in the liquid, whereby the contaminant is cleaned from the orifice while the shearing force acts against the contaminant and whereby the contaminant is entrained in the liquid while the contaminant is cleaned from the orifice;

(ii) disposing a valve system in fluid communication with the gap for changing flow of the fluid from the first direction to a second direction opposite the first direction;

(iii) disposing an ultrasonic transducer in fluid communication with the fluid for generating a pressure wave propagating in the fluid and acting against the contaminant, whereby the surface is cleaned of the contaminant while the shearing force and pressure wave act against the contaminant and while the contaminant is agitated;

(iv) disposing a pump in fluid communication with the cavity for pumping the fluid and entrained contaminant from the cavity; and (c) connecting a controller to the cleaning assembly and the print head for controlling operation thereof.

* * * * *

UNITED STATES PATENT AND TRADEMARK OFFICE

CERTIFICATE OF CORRECTION

PATENT NO. : 6,183,057 B1
DATED : February 6, 2001
INVENTOR(S) : Ravi Sharma, et al.

It is certified that error appears in the above-identified patent and that said Letters Patent is hereby corrected as shown below:

Column 16, claim 19,
Line 12, -- after "fluid" insert -- in a first direction -- --

Signed and Sealed this

Twenty-third Day of October, 2001

*Attest:*

Nicholas P. Godici

NICHOLAS P. GODICI
*Acting Director of the United States Patent and Trademark Office*

*Attesting Officer*